US008157517B2

(12) United States Patent
Feher et al.

(10) Patent No.: US 8,157,517 B2
(45) Date of Patent: Apr. 17, 2012

(54) BOLTLESS MULTI-PART DIAPHRAGM FOR USE WITH A CENTRIFUGAL COMPRESSOR

(75) Inventors: Timothy A. Feher, Belle Vernon, PA (US); Samuel K. Kemp, Stahlstown, PA (US); Stephen Mark Hanak, Brownsville, PA (US)

(73) Assignee: Elliott Company, Jeannette, PA (US)

( * ) Notice: Subject to any disclaimer, the term of this patent is extended or adjusted under 35 U.S.C. 154(b) by 507 days.

(21) Appl. No.: 12/430,444

(22) Filed: Apr. 27, 2009

(65) Prior Publication Data

US 2010/0272561 A1 Oct. 28, 2010

(51) Int. Cl.
*F04D 29/44* (2006.01)
*F04D 29/54* (2006.01)

(52) U.S. Cl. ..... 415/209.2; 415/199.2; 415/203; 416/215; 416/189

(58) Field of Classification Search ..... 415/209.2, 415/203, 224, 191, 199.2, 199.3; 416/185, 416/215
See application file for complete search history.

(56) References Cited

U.S. PATENT DOCUMENTS

| | | | | |
|---|---|---|---|---|
| 2,625,365 | A | | 1/1953 | Moore |
| 3,300,180 | A | | 1/1967 | Tuttle et al. |
| 3,313,520 | A | | 4/1967 | Ortolano et al. |
| 3,367,630 | A | | 2/1968 | Saunders |
| 3,825,368 | A | | 7/1974 | Benjamin |
| 4,428,717 | A | | 1/1984 | Catterfeld |
| 4,720,242 | A | | 1/1988 | Lovisetto |
| 5,328,332 | A | | 7/1994 | Chiang |
| 5,344,285 | A | * | 9/1994 | O'Sullivan et al. ..... 415/199.2 |
| 6,033,183 | A | | 3/2000 | Genster |
| 6,146,094 | A | | 11/2000 | Obana et al. |
| 6,854,960 | B2 | | 2/2005 | Van Dine et al. |
| 6,884,037 | B2 | | 4/2005 | Lacey et al. |
| 7,273,352 | B2 | | 9/2007 | Williams et al. |
| 7,338,251 | B2 | | 3/2008 | Ro et al. |
| 2003/0235502 | A1 | | 12/2003 | Van Dine et al. |
| 2006/0280609 | A1 | | 12/2006 | Ranz et al. |

FOREIGN PATENT DOCUMENTS

| | | | |
|---|---|---|---|
| DE | 19742023 | A1 | 3/1999 |
| JP | 56162298 | A | 12/1981 |
| WO | 2005045252 | A1 | 5/2005 |

* cited by examiner

*Primary Examiner* — David Nhu
(74) *Attorney, Agent, or Firm* — The Webb Law Firm

(57) ABSTRACT

A diaphragm assembly of a centrifugal compressor includes a return channel wall having a generally ring-like shape; a vane assembly having a plurality of vanes formed integrally with at least one ring-shaped track having a rail structure extending therefrom; and a diaphragm wall having a generally ring-like shape and at least one groove extending around a circumference thereof. The vane assembly is fixedly coupled to the return channel, thereby forming a return channel assembly. The return channel assembly is coupled to the diaphragm wall by sliding the rail structure into the at least one groove of the diaphragm wall.

19 Claims, 10 Drawing Sheets

BOLTLESS MULTI-PART DIAPHRAGM FOR USE WITH A CENTRIFUGAL COMPRESSOR

BACKGROUND OF THE INVENTION

1. Field of the Invention

The present invention, in general, is related to multi-stage centrifugal compressors and, more particularly, to a diaphragm assembly for use with a multi-stage centrifugal compressor.

2. Description of Related Art

Multi-stage centrifugal compressors are well-known in the art. A typical multi-stage centrifugal compressor includes a compressor casing that accommodates a series of diaphragms, and a rotor in the form of a shaft with impellers installed thereon. The diaphragms include internal channels which, together with the impellers, form a flow duct of the compressor.

A typical diaphragm includes a return channel, a plurality of blades or vanes, and a diaphragm wall that are bolted together. Both turbines and compressors usually include such diaphragms. For instance, U.S. Pat. No. 3,330,180 to Tuttle et al. discloses a diaphragm assembly for use with a turbine. The diaphragm assembly includes an outer retaining ring and a concentric, inner retaining disc. The retaining ring and disc are each split along the same horizontal plane. Accordingly, the retaining ring includes ring segments and the disc includes segments. The segments are coupled together with screws that extend through an oversized bore segment into a threaded bore segment. The diaphragm assembly further includes nozzle blade segments that extend between the radial inner surface of the retaining ring and the periphery of the disc. U.S. Pat. No. 3,367,630 to Saunder discloses a similar configuration.

However, such prior art diaphragm configurations suffer from various deficiencies. First, such diaphragms include a large number of parts that must be assembled using specialty bolting. Accordingly, prior art diaphragm assemblies have been expensive to manufacture due to the large number of parts and the expensive specialty bolting required. In addition, such diaphragm assemblies are difficult to disassemble, thereby making cleaning of the assemblies problematic.

Therefore, a need exists for a diaphragm assembly for use with a centrifugal compressor that includes a minimum number of parts that can be quickly and easily assembled without the use of expensive specialty bolting. In addition, a further need exists for a diaphragm assembly that can be easily disassembled, thereby allowing for easier cleaning of the diaphragm assembly.

SUMMARY OF THE INVENTION

Accordingly, an object of the present invention is to provide a diaphragm assembly for use with a centrifugal compressor that includes a minimum number of parts that can be quickly and easily assembled without the use of expensive specialty bolting. In addition, another object of the present invention is to provide a diaphragm assembly that can be easily disassembled, thereby allowing for easier cleaning of the diaphragm assembly.

The present invention is directed to a diaphragm assembly of a centrifugal compressor. The diaphragm assembly includes a return channel wall having a generally ring-like shape; a vane assembly having a plurality of vanes formed integrally with at least one ring-shaped track having a rail structure extending therefrom; and a diaphragm wall having a generally ring-like shape and at least one groove extending around a circumference thereof. The vane assembly is fixedly coupled to the return channel, thereby forming a return channel assembly. The return channel assembly is coupled to the diaphragm wall by sliding the rail structure into the at least one groove of the diaphragm wall.

The return channel wall may be manufactured as one of a single piece, half segments, or quarter segments by milling, casting, powder metal techniques, or waterjet techniques. The vane assembly may also be manufactured as a single piece, half segments, or quarter segments by milling, casting, powder metal techniques, or waterjet techniques. The return channel wall may be fixedly coupled to the vane assembly by one of welding, slot welding, and brazing. The diaphragm wall may be manufactured by one of milling, casting, powder metal techniques, and waterjet techniques.

The vane assembly may include two tracks positioned concentrically with each other and each track may have a rail structure extending therefrom. The rail structure may have a cross-sectional shape that is T-shaped, L-shaped, dove-tail shaped, or any other suitable interlocking geometric shape. The at least one groove in the diaphragm wall may have a cross-sectional shape that corresponds to the cross-sectional shape of the rail structure. The at least one groove in the diaphragm wall may have a cross-sectional shape that is T-shaped, L-shaped, dove-tail shaped, or any other suitable interlocking geometric shape. The rail structure may include a plurality of equally spaced segments, and the groove includes a plurality of equally spaced pockets configured to receive the segments and lock the segments when the return channel assembly is rotated.

The present invention is also directed to a centrifugal compressor that includes a casing and a plurality of stages positioned within the casing. Each of the stages includes an impeller assembly and a diaphragm assembly encompassing the impeller assembly. The diaphragm assembly has a return channel wall having a generally ring-like shape; a vane assembly having a plurality of vanes formed integrally with at least one ring-shaped track having a rail structure extending therefrom; and a diaphragm wall having a generally ring-like shape and at least one groove extending around a circumference thereof. The vane assembly is fixedly coupled to the return channel, thereby forming a return channel assembly. The return channel assembly is coupled to the diaphragm wall by sliding the rail structure into the at least one groove of the diaphragm wall.

The rail structure may include a cross-sectional shape that is T-shaped, L-shaped, dove-tail shaped, or any other suitable interlocking geometric shape. The at least one groove in the diaphragm wall may have a cross-sectional shape that corresponds to the cross-sectional shape of the rail structure. The at least one groove in the diaphragm wall may have a cross-sectional shape that is T-shaped, L-shaped, dove-tail shaped, or any other suitable interlocking geometric shape.

Finally, the present invention is a method of manufacturing a diaphragm assembly for use with a centrifugal compressor. The method includes the steps of: a) manufacturing a vane assembly having a plurality of vanes formed integrally with at least one ring-shaped track having a rail structure extending therefrom; b) manufacturing a return channel wall having a generally ring-like shape; c) fixedly coupling the return channel wall to the vane assembly; d) manufacturing a diaphragm wall having a generally ring-like shape and at least one groove extending around a circumference thereof; and e) coupling the return channel assembly to the diaphragm wall by sliding the rail structure into the at least one groove of the diaphragm wall.

The return channel wall, the vane assembly, and the diaphragm wall may each be manufactured by one of milling, casting, powder metal techniques, and waterjet techniques. The return channel wall may be fixedly coupled to the vane assembly by one of welding, slot welding, and brazing.

These and other features and characteristics of the present invention, as well as the methods of operation and functions of the related elements of structures and the combination of parts and economies of manufacture, will become more apparent upon consideration of the following description and the appended claims with reference to the accompanying drawings, all of which form a part of this specification, wherein like reference numerals designate corresponding parts in the various figures. It is to be expressly understood, however, that the drawings are for the purpose of illustration and description only and are not intended as a definition of the limits of the invention. As used in the specification and the claims, the singular form of "a", "an", and "the" include plural referents unless the context clearly dictates otherwise.

DETAILED DESCRIPTION OF THE PRESENT INVENTION

Figure 1:
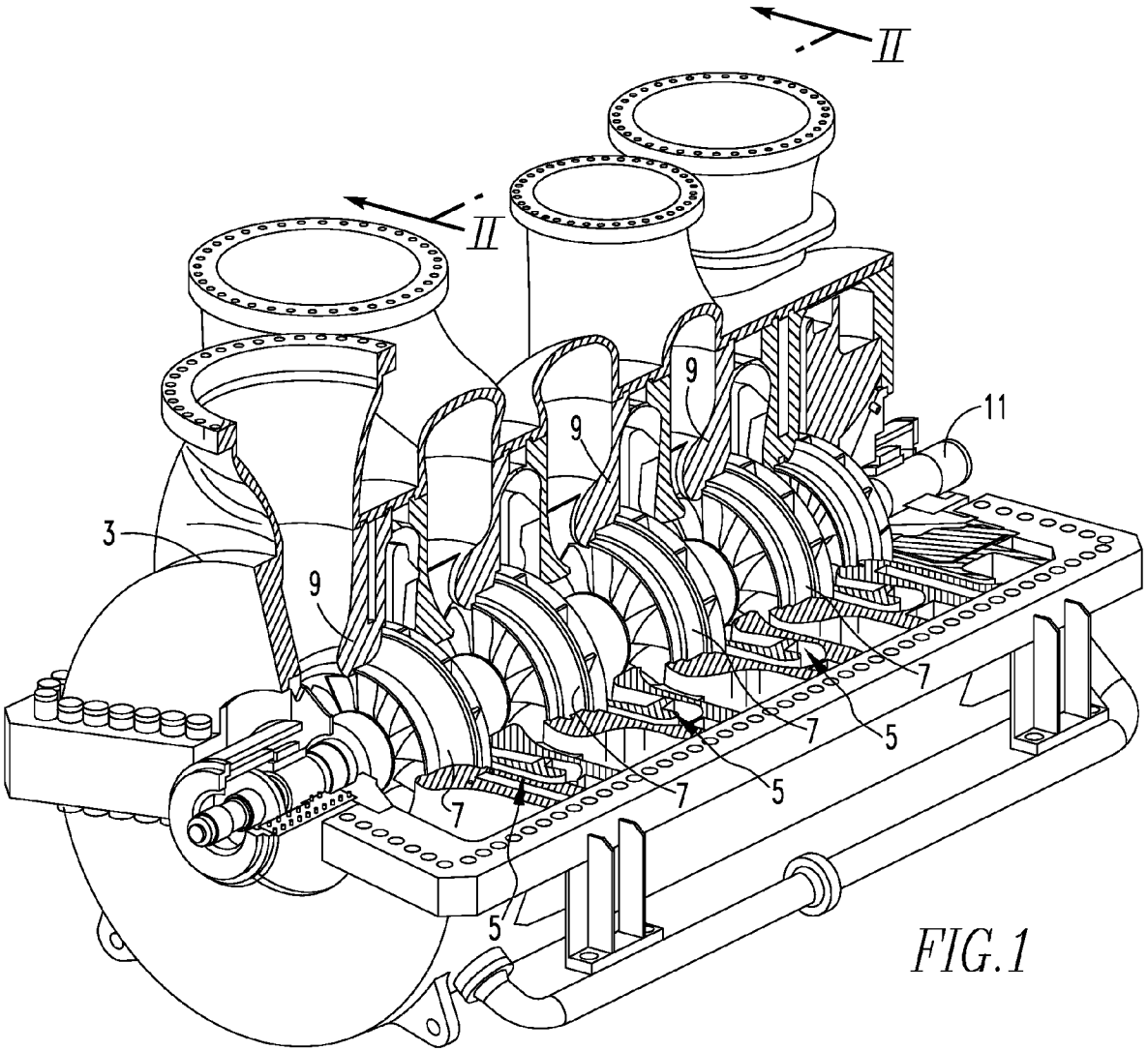
FIG. 1 is a perspective view of a multi-stage centrifugal compressor in partial cross-section that includes a diaphragm assembly in accordance with the present invention.

For purposes of the description hereinafter, the terms "upper", "lower", "right", "left", "vertical", "horizontal", "top", "bottom", "lateral", "longitudinal", and derivatives thereof shall relate to the invention as it is oriented in the drawing figures. However, it is to be understood that the invention may assume various alternative variations and step sequences, except where expressly specified to the contrary. It is also to be understood that the specific devices and processes illustrated in the attached drawings, and described in the following specification, are simply exemplary embodiments of the invention. Hence, specific dimensions and other physical characteristics related to the embodiments disclosed herein are not to be considered as limiting.

Figure 2:
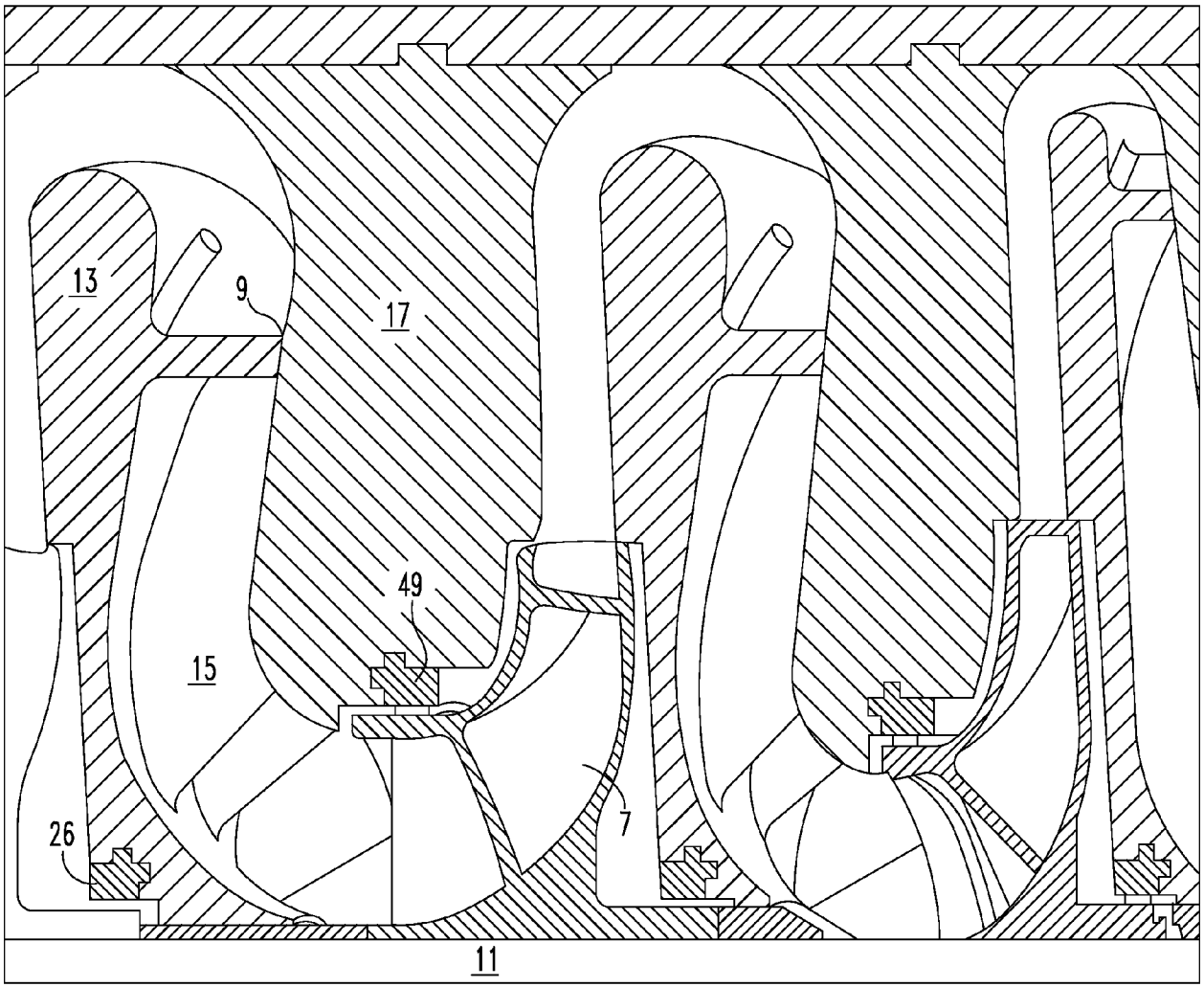
FIG. 2 is a cross-sectional view of the centrifugal compressor of FIG. 1 taken along line II-II.

With reference to FIGS. 1 and 2, a centrifugal compressor 1 includes a casing 3 and a plurality of stages 5 positioned within casing 3. Each of stages 5 includes an impeller assembly 7 and a diaphragm assembly 9 encompassing impeller assembly 7. Each impeller assembly 7 is positioned along a shaft 11.

Figure 3:
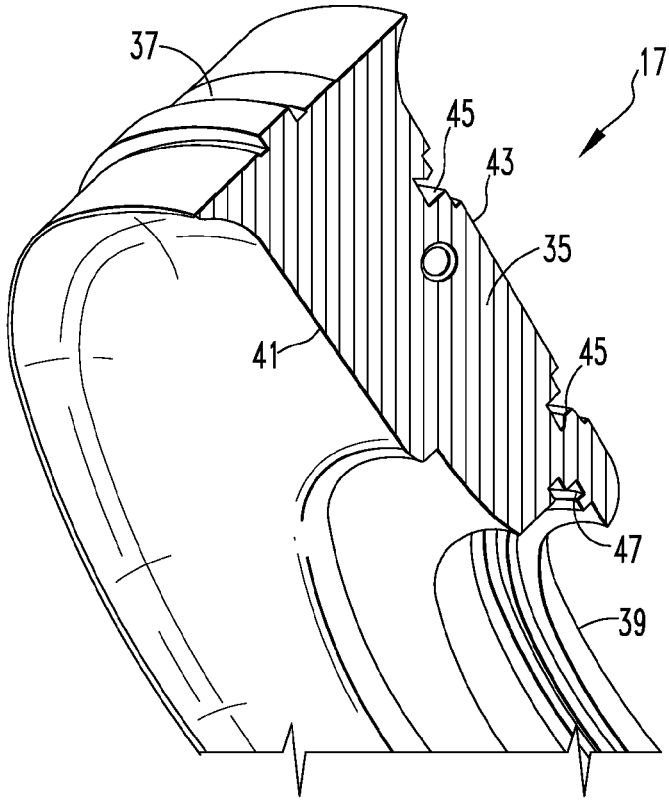
FIG. 3 is a partial perspective view of a diaphragm wall of the diaphragm assembly in accordance with the present invention.
Figure 4:
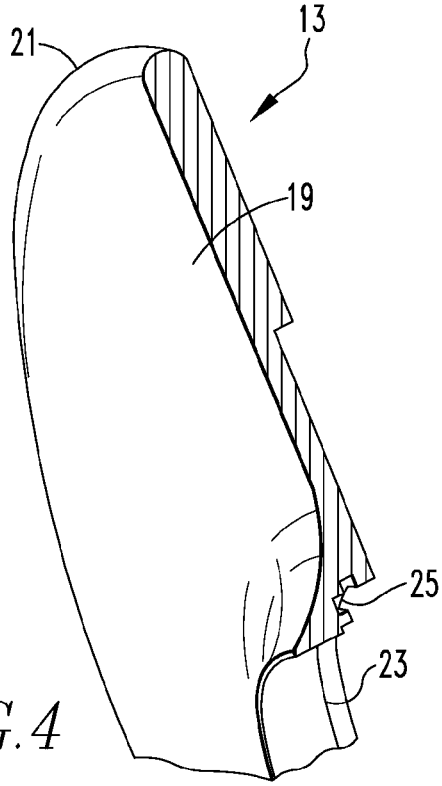
FIG. 4 is a partial perspective view of a return channel wall of the diaphragm assembly in accordance with the present invention.

With reference to FIGS. 3-10 and with continued reference to FIGS. 1 and 2, diaphragm assembly 9 includes a return channel wall 13, a vane assembly 15, and a diaphragm wall 17. Return channel wall 13, as shown in FIG. 4, has a generally ring-like body portion 19 having an outer circumference 21 and an inner circumference 23. Body portion 19 of return channel wall 13 may be manufactured as half segments or quarter segments. Desirably, body portion 19 of return channel wall 13 is manufactured in quarter segments and each of the quarter segments is assembled to form body portion 19 having a ring-like shape. Each segment of body portion 19 may be manufactured by milling, casting, powder metal techniques, or waterjet techniques. Body portion 19 further includes a groove 25 formed around inner circumference 23 thereof. Groove 25 is configured to receive a seal 26 when diaphragm assembly 9 is assembled in a stage 5 of compressor 1.

Figure 5:
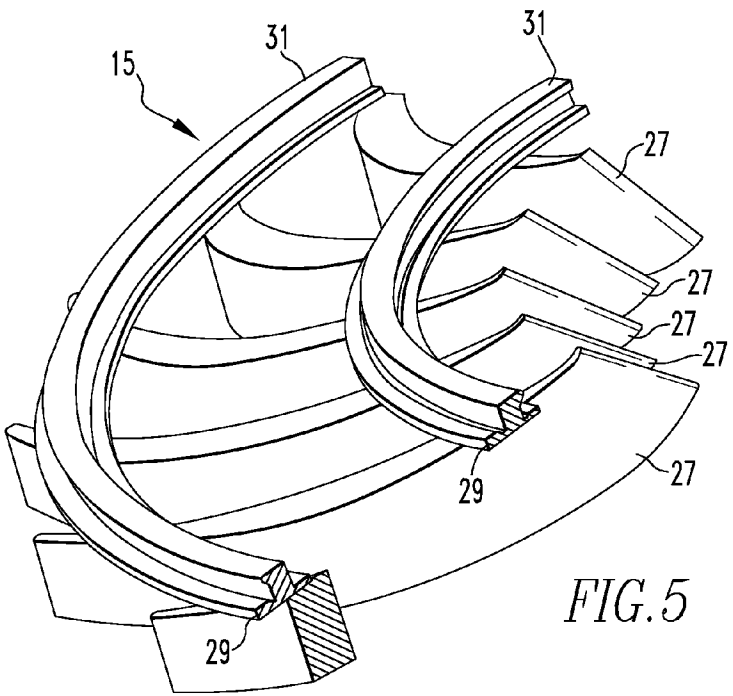
FIG. 5 is a bottom perspective view of a vane segment of the diaphragm assembly in accordance with the present invention.
Figure 6:
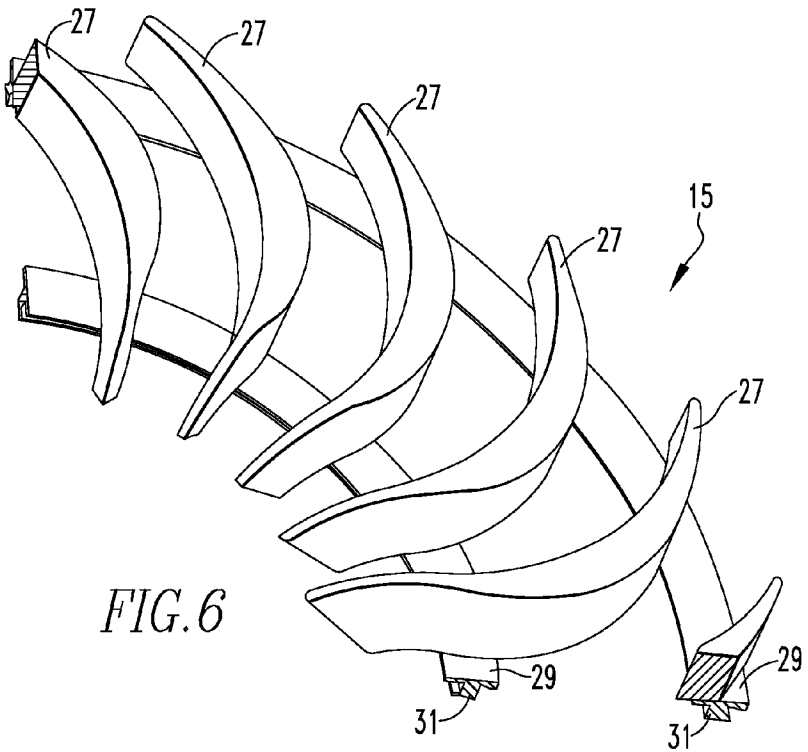
FIG. 6 is a top perspective view of the vane segment of FIG. 5.

Vane assembly 15, as shown in FIGS. 5 and 6, includes a plurality of vanes 27 formed integrally with at least one ring-shaped track 29. Desirably, and as shown in FIGS. 5 and 6, vane assembly 15 includes two ring-shaped tracks 29 positioned concentrically with each other. However, this is not to be construed as limiting the present invention as any suitable number of tracks may be utilized. Each of tracks 29 includes a rail structure 31 extending therefrom. Rail structure 31 may have a dove-tail cross-sectional shape as shown in FIGS. 5 and 6; however, this is not to be construed as limiting the present invention as other cross-sectional shapes, such as T-shaped, L-shaped, or any other suitable interlocking geometric shape, have been envisioned.

Figure 7:
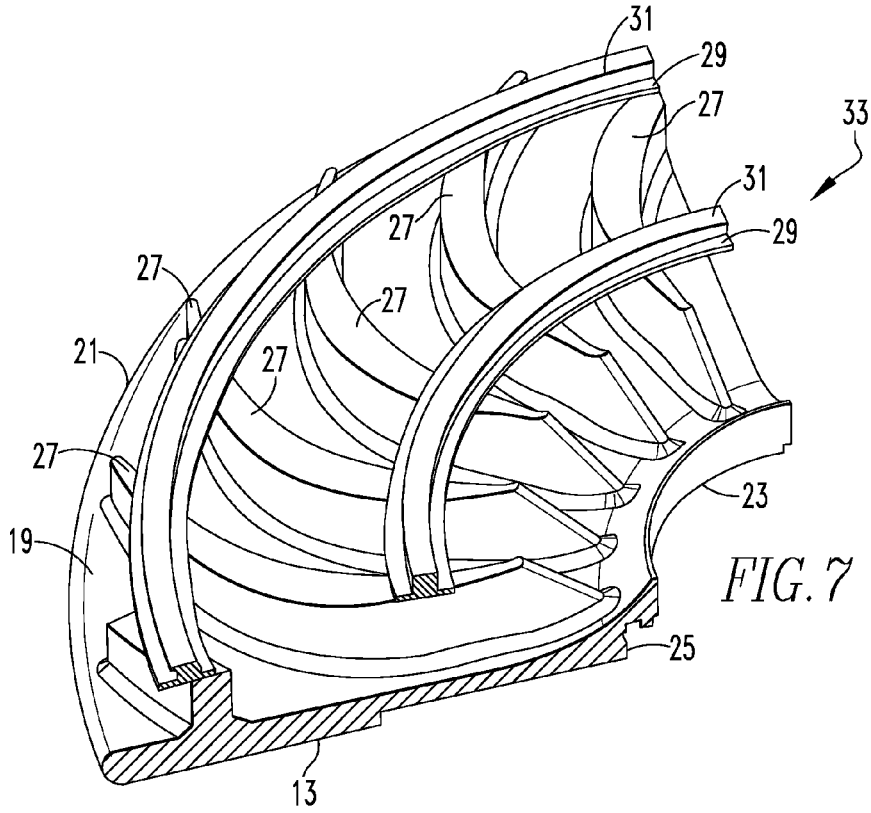
FIG. 7 is a partial perspective view of the return channel wall of FIG. 4 coupled to the vane segment of FIGS. 5 and 6 to form a return channel assembly.

Vane assembly 15 may be manufactured as half segments or quarter segments. Desirably, vane assembly 15 is manufactured in quarter segments to correspond to return channel wall assembly 13. Each segment of vane assembly 15 may be manufactured by milling, casting, powder metal techniques, or waterjet techniques. Return channel wall 13 is fixedly coupled to vane assembly 15 by welding, slot welding, or brazing to form a return channel assembly 33 as shown in FIG. 7.

Diaphragm wall 17, as shown in FIG. 3, has a generally ring-like body portion 35 having an outer circumference 37, an inner circumference 39, a front face 41, and a rear face 43. Body portion 35 of diaphragm wall 17 may be manufactured as half segments and each of the half segments is assembled to form body portion 35 having a ring-like shape. Each segment of body portion 35 may be manufactured by milling, casting, powder metal techniques, or waterjet techniques. At least one groove 45 is formed in rear face 43 of body portion 35 and extends around a circumference thereof. Desirably, and as shown in FIG. 3, body portion 35 includes two grooves 45 positioned concentrically with each other. However, this is not to be construed as limiting the present invention as any suitable number of grooves 45 may be utilized. The number of grooves 45 should correspond to the number of tracks 29 of vane assembly 15. Grooves 45 may have a dove-tail cross-sectional shape as shown in FIG. 3 to correspond to the cross-sectional shape of rail structures 31 of vane assembly 15; however, this is not to be construed as limiting the present invention as other cross-sectional shapes for grooves 45, such as T-shaped, L-shaped, or any other suitable interlocking geometric shape, have been envisioned. Body portion 35 further includes a second groove 47 formed around inner circumference 39 thereof. Second groove 47 is configured to receive a seal 49 when diaphragm assembly 9 is assembled in a stage 5 of compressor 1.

Figure 8:
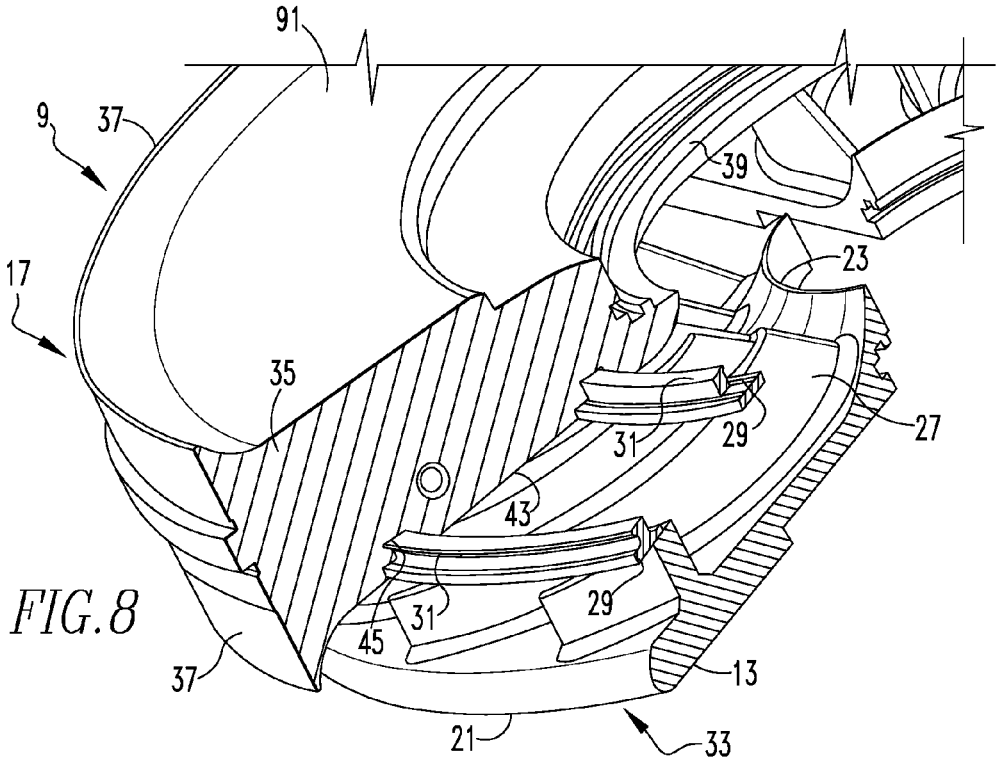
FIG. 8 is a partial cross-sectional view illustrating the manner in which the return channel assembly of FIG. 7 is coupled to the diaphragm wall of FIG. 3.
Figure 9:
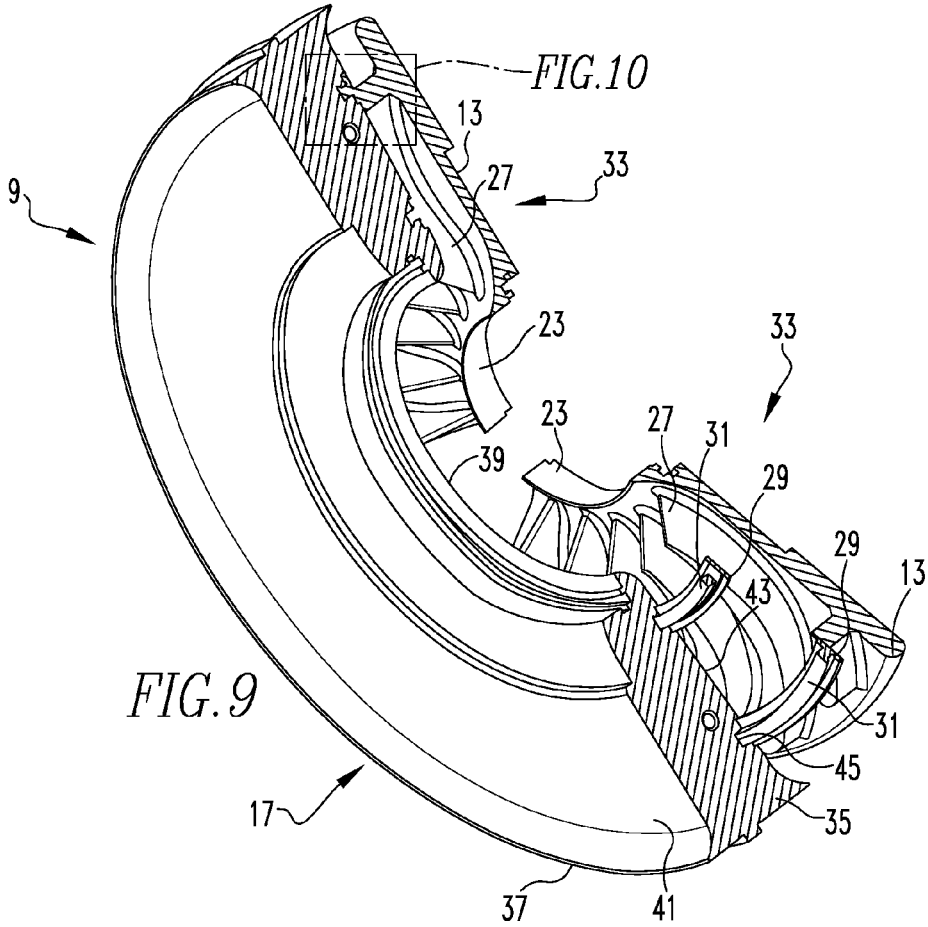
FIG. 9 is a perspective view of the diaphragm wall of the diaphragm assembly with a first return channel assembly coupled thereto.
Figure 10:
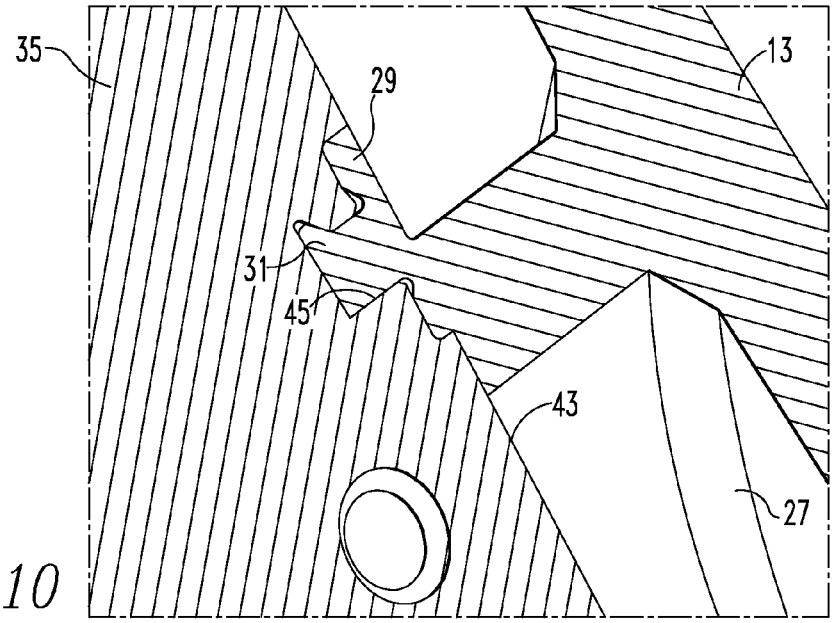
FIG. 10 is a portion of the diaphragm assembly of FIG. 9 enlarged for magnification purposes.

With reference to FIGS. 8-10 and with continuing reference to FIGS. 1-7, once return channel assembly 33 and diaphragm wall 17 are manufactured, they are assembled as follows: first, one of the quarter segments of return channel assembly 33 is coupled to the half segment of diaphragm wall 17 by sliding rail structures 31 into grooves 45 of diaphragm wall 17. The travel of rail structures 31 in grooves 45 may be anywhere from 0 to 180 degrees per half segment of diaphragm wall 17. Next, another one of the quarter segments of return channel assembly 33 is coupled to the half segment of diaphragm wall 17 by sliding rail structures 31 into grooves 45 of diaphragm wall 17. This process is then repeated for the other half segment of diaphragm wall 17 and quarter segments of return channel assembly 33. The two half segments of diaphragm wall 17 are then coupled together to form diaphragm assembly 9.

Accordingly, diaphragm assembly 9 includes a minimum number of parts since each of vanes 27 is formed as part of an integral vane assembly 15. In addition, diaphragm assembly 9 can be quickly and easily assembled without the use of expensive specialty bolting. Diaphragm assembly 9 can also be easily disassembled, thereby allowing for easier and more efficient cleaning of diaphragm assembly 9.

Figure 11:
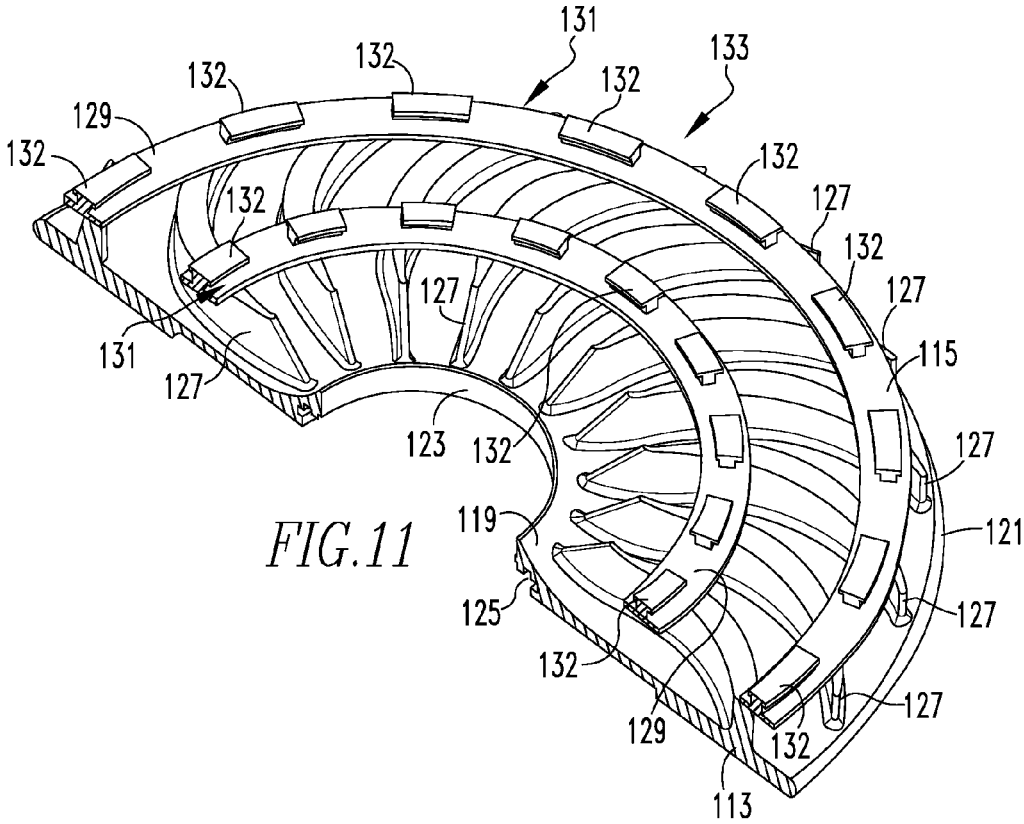
FIG. 11 is a top perspective view of an alternative embodiment of a return channel assembly of the diaphragm assembly in accordance with the present invention.
Figure 12:
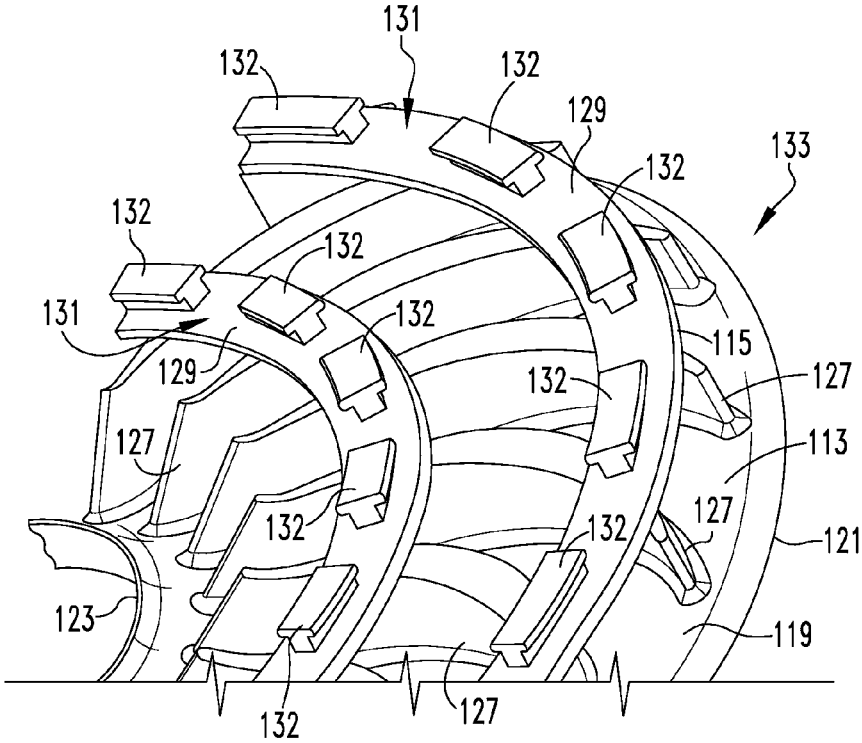
FIG. 12 is a top perspective view of the return channel assembly of FIG. 11 taken from a different angle.
Figure 13:
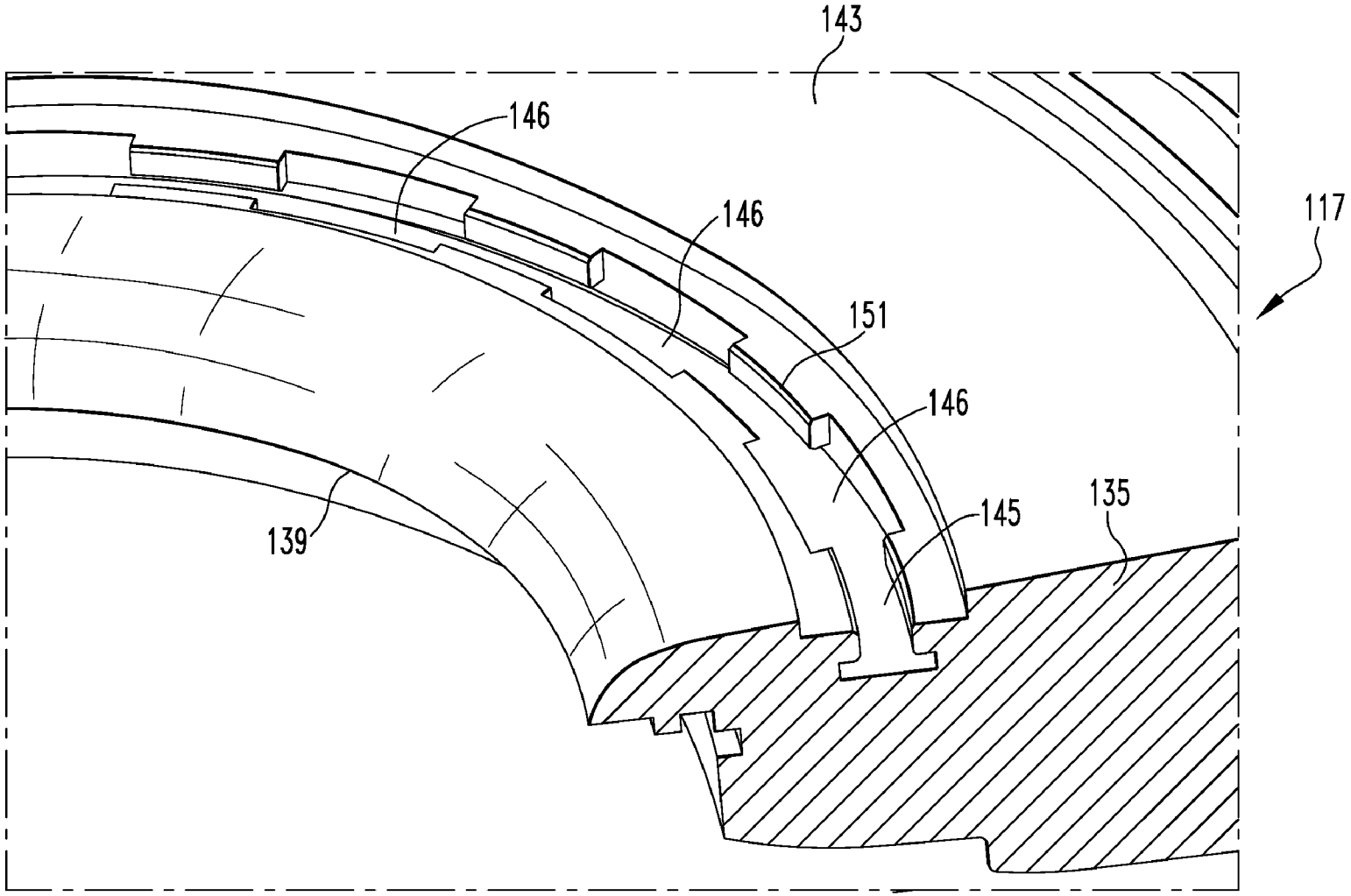
FIG. 13 is a top perspective view of a portion of an alternative embodiment of the diaphragm wall of the diaphragm assembly in accordance with the present invention.

With reference to FIGS. 11-13, an alternative embodiment of return channel assembly 133 and diaphragm wall 117 are illustrated. Return channel wall assembly 133 includes a return channel wall 113 and a vane assembly 115 that are fixedly coupled together by welding, slot welding, or brazing.

Return channel wall 113 has a generally ring-like body portion 119 having an outer circumference 121 and an inner circumference 123. Body portion 119 of return channel wall 113 may be manufactured as one piece, half segments, or quarter segments. Body portion 119 may be manufactured by milling, casting, powder metal techniques, or waterjet techniques. Body portion 119 further includes a groove 125 formed around inner circumference 123 thereof. Groove 125 is configured to receive a seal 26 when diaphragm assembly 9 is assembled in a stage 5 of compressor 1.

Vane assembly 115 includes a plurality of vanes 127 formed integrally with at least one ring-shaped track 129. Desirably, vane assembly 115 includes two ring-shaped tracks 129 positioned concentrically with each other. However, this is not to be construed as limiting the present invention as any suitable number of tracks may be utilized. Each of tracks 129 includes a rail structure 131 extending therefrom. Rail structure 131 includes a plurality of equally spaced segments 132. Each of segments 132 have a T-shaped cross-sectional shape.

Vane assembly 115 may be manufactured as one piece, half segments, or quarter segments. Vane assembly 115 may be manufactured by milling, casting, powder metal techniques, or waterjet techniques. Return channel wall 113 is then fixedly coupled to vane assembly 115 by welding, slot welding, or brazing to form return channel assembly 133 as shown in FIGS. 11 and 12.

Diaphragm wall 117, as shown in FIG. 13, has a generally ring-like body portion 135 having an outer circumference 137, an inner circumference 139, a front face 141, and a rear face 143. Body portion 135 of diaphragm wall 117 may be manufactured as one piece or as half segments. Body portion 135 may be manufactured by milling, casting, powder metal techniques, or waterjet techniques. At least one groove 145 is formed in rear face 143 of body portion 135 and extends around a circumference thereof. Desirably, and as shown in FIG. 13, body portion 135 includes two grooves 145 positioned concentrically with each other. However, this is not to be construed as limiting the present invention as any suitable number of grooves 145 may be utilized. The number of grooves 145 should correspond to the number of tracks 129 of vane assembly 115. Each groove 145 includes a plurality of equally spaced pockets 146 configured to receive segments 132 therein. Pockets 146 are formed in groove 145 by milling, for instance. Grooves 145 may have a T-shaped cross-sectional shape as shown in FIG. 13 to correspond to the cross-sectional shape of rail structures 131 of vane assembly 115. Body portion 135 further includes a second groove 147 formed around inner circumference 139 thereof. Second groove 147 is configured to receive a seal 149 when a diaphragm assembly 109 is assembled in a stage 5 of compressor 1.

Figure 14:
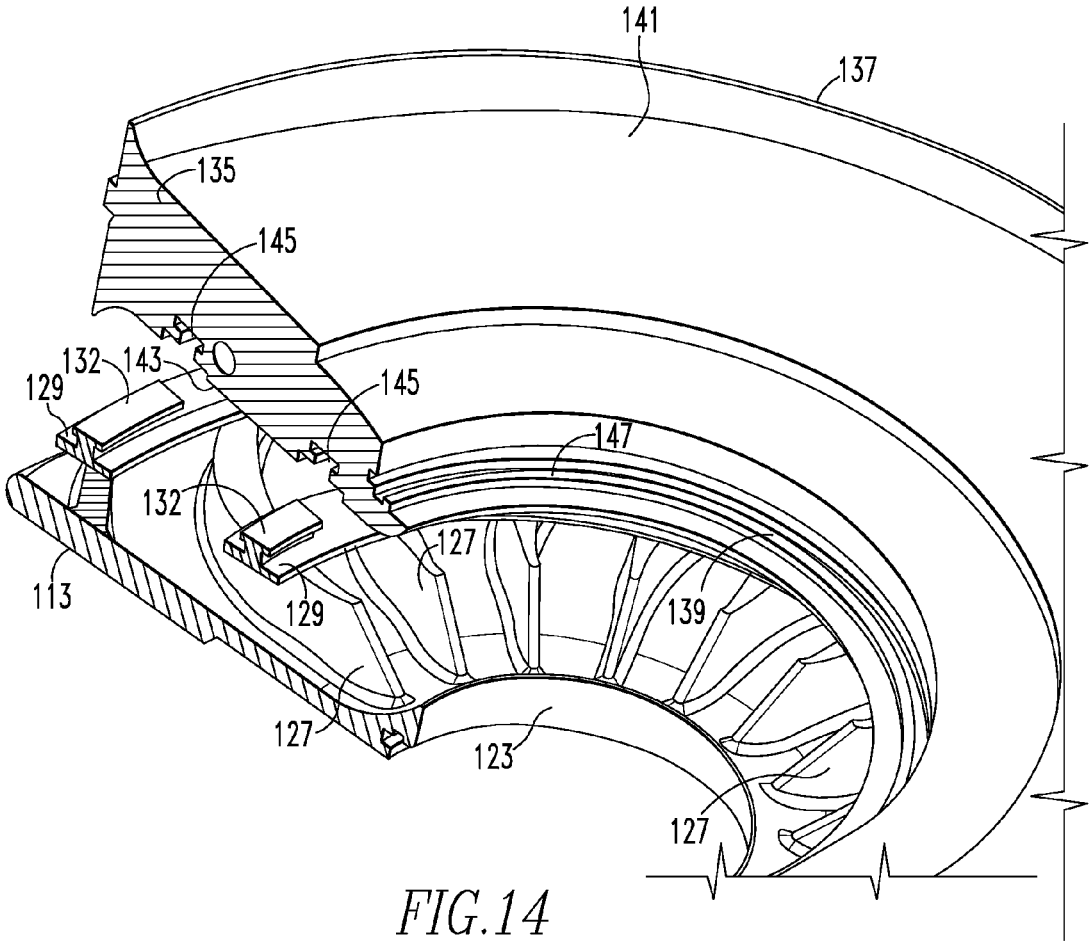
FIG. 14 is a partial perspective view of the return channel assembly of FIG. 11 and the diaphragm wall of FIG. 13.
Figure 15:
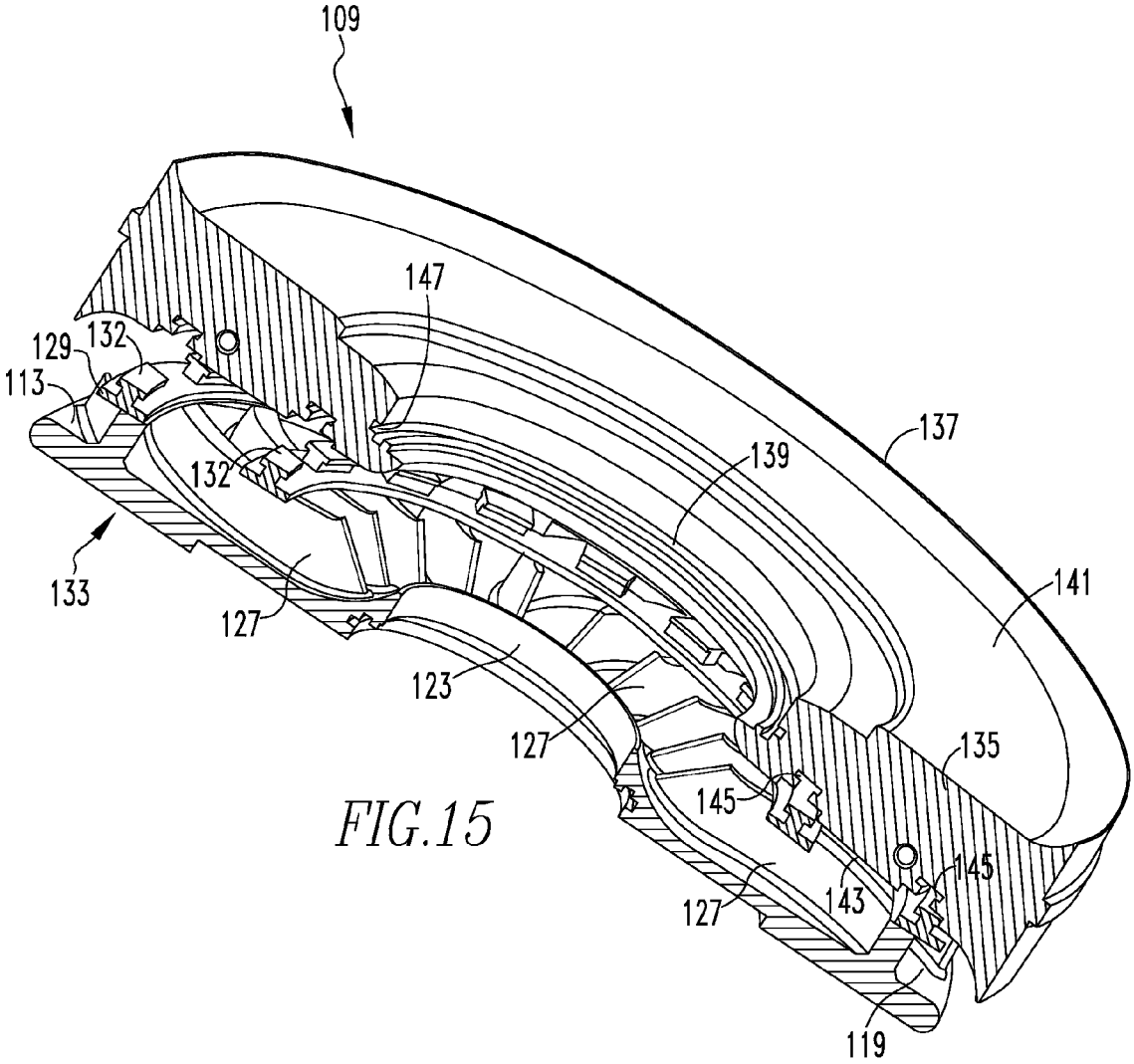
FIG. 15 is a full perspective view of the return channel assembly of FIG. 11 and the diaphragm wall of FIG. 13

With reference to FIGS. 14 and 15 and with continuing reference to FIGS. 11-13, once return channel assembly 133 and diaphragm wall 117 are manufactured, they are assembled as follows: first, a first half segment of return channel assembly 133 is coupled to a half segment of diaphragm wall 117 by lowering return channel assembly 133 onto diaphragm wall 117 such that each segment 132 of rail structure 131 is received within a pocket 146 of groove 145. Return channel assembly 133 is then rotated, such that segments 132 are locked within groove 145 underneath tab portions 151 formed within groove 145. The travel of rail structures 131 in grooves 145 is approximately 12 degrees. A possible fixture to use during this process is a hydraulic table. The hydraulic table would be configured to raise or lower either return channel assembly 133 or diaphragm wall 117 such that segments 132 of rail structure 131 are positioned within pockets 146 of groove 145. The hydraulic table would then rotate to lock segments 132 within groove 145 underneath tab portions 151 formed therein. This process is then repeated for the other half segment of diaphragm wall 117 and return channel assembly 133. The two half segments of diaphragm wall 117 are then coupled together to form diaphragm assembly 109. Alternatively, diaphragm wall 117 and return channel wall 115 may be formed as a single piece and assembled as discussed hereinabove.

Although the invention has been described in detail for the purpose of illustration based on what is currently considered to be the most practical and preferred embodiments, it is to be understood that such detail is solely for that purpose and that the invention is not limited to the disclosed embodiments, but, on the contrary, is intended to cover modifications and equivalent arrangements that are within the spirit and scope of the appended claims. For example, it is to be understood that the present invention contemplates that, to the extent possible, one or more features of any embodiment can be combined with one or more features of any other embodiment.

The invention claimed is:

1. A diaphragm assembly of a centrifugal compressor comprising:

a return channel wall having a generally ring-like shape;

a vane assembly having a plurality of vanes formed integrally with at least one ring-shaped track having a rail structure extending therefrom, the vane assembly is fixedly coupled to the return channel wall, thereby forming a return channel assembly; and a diaphragm wall having a generally ring-like shape and at least one groove extending around a circumference thereof, wherein the return channel assembly is coupled to the diaphragm wall by sliding the rail structure into the at least one groove of the diaphragm wall.

2. The diaphragm assembly of claim 1, wherein the return channel wall is manufactured as one of a single piece, half segments, and quarter segments.

3. The diaphragm assembly of claim 2, wherein the return channel wall is manufactured by one of milling, casting, powder metal techniques, and waterjet techniques.

4. The diaphragm assembly of claim 1, wherein the vane assembly is manufactured as one of a single piece, half segments, and quarter segments.

5. The diaphragm assembly of claim 4, wherein the vane assembly is manufactured by one of milling, casting, powder metal techniques, and waterjet techniques.

6. The diaphragm assembly of claim 1, wherein the vane assembly includes two tracks positioned concentrically with each other and each track having a rail structure extending therefrom.

7. The diaphragm assembly of claim 1, wherein the rail structure has a cross-sectional shape that is one of T-shaped, L-shaped, and dove-tail shaped.

8. The diaphragm assembly of claim 1, wherein the at least one groove in the diaphragm wall has a cross-sectional shape that corresponds to the cross-sectional shape of the rail structure.

9. The diaphragm assembly of claim 1, wherein the at least one groove in the diaphragm wall has a cross-sectional shape that is one of T-shaped, L-shaped, and dove-tail shaped.

10. The diaphragm assembly of claim 1, wherein the return channel wall is fixedly coupled to the vane assembly by one of welding, slot welding, and brazing.

11. The diaphragm assembly of claim 1, wherein the diaphragm wall is manufactured by one of milling, casting, powder metal techniques, and waterjet techniques.

12. The diaphragm assembly of claim 1, wherein the rail structure includes a plurality of equally spaced segments, and the groove includes a plurality of equally spaced pockets configured to receive the segments and lock the segments when the return channel assembly is rotated.

13. A centrifugal compressor comprising:

a casing; and a plurality of stages positioned within the casing, wherein each of the stages comprises:

an impeller assembly; and a diaphragm assembly encompassing the impeller assembly, the diaphragm assembly comprising:

a return channel wall having a generally ring-like shape;

a vane assembly having a plurality of vanes formed integrally with at least one ring-shaped track having a rail structure extending therefrom, the vane assembly is fixedly coupled to the return channel wall, thereby forming a return channel assembly; and a diaphragm wall having a generally ring-like shape and at least one groove extending around a circumference thereof, wherein the return channel assembly is coupled to the diaphragm wall by sliding the rail structure into the at least one groove of the diaphragm wall.

14. The centrifugal compressor of claim 13, wherein the rail structure has a cross-sectional shape that is one of T-shaped, L-shaped, and dove-tail shaped.

15. The centrifugal compressor of claim 13, wherein the at least one groove in the diaphragm wall has a cross-sectional shape that corresponds to the cross-sectional shape of the rail structure.

16. The centrifugal compressor of claim 13, wherein the at least one groove in the diaphragm wall has a cross-sectional shape that is one of T-shaped, L-shaped, and dove-tail shaped.

17. A method of manufacturing a diaphragm assembly for use with a centrifugal compressor comprising the steps of:

a) manufacturing a vane assembly having a plurality of vanes formed integrally with at least one ring-shaped track having a rail structure extending therefrom;

b) manufacturing a return channel wall having a generally ring-like shape;

c) fixedly coupling the return channel wall to the vane assembly thereby forming a return channel assembly;

d) manufacturing a diaphragm wall having a generally ring-like shape and at least one groove extending around a circumference thereof; and e) coupling the return channel assembly to the diaphragm wall by sliding the rail structure into the at least one groove of the diaphragm wall.

18. The method of claim 17, wherein the return channel wall, the vane assembly, and the diaphragm wall are each manufactured by one of milling, casting, powder metal techniques, and waterjet techniques.

19. The method of claim 17, wherein the return channel wall is fixedly coupled to the vane assembly by one of welding, slot welding, and brazing.

* * * * *